United States Patent [19]

Chan et al.

[11] Patent Number: 5,025,735

[45] Date of Patent: Jun. 25, 1991

[54] PALLET ASSEMBLY WHICH INTERLOCKS WITH WIRE REELS

[75] Inventors: Ronald E. Chan, Elk Grove Village; Gerald F. Colby, Palatine, both of Ill.

[73] Assignee: Chicago Magnet Wire Co., Elk Grove Village, Ill.

[21] Appl. No.: 55,655

[22] Filed: May 28, 1987

[51] Int. Cl.[5] ..... B65D 19/44

[52] U.S. Cl. ..... 108/55.3; 108/53.1

[58] Field of Search ..... 108/55.1, 55.3, 53.1, 108/53.3, 53.5, 51.1, 901, 902; 29/288; 211/49.1

[56] References Cited

U.S. PATENT DOCUMENTS

| | | | |
|---|---|---|---|
| 2,444,326 | 8/1948 | Baker et al. | 108/55.3 |
| 2,774,474 | 12/1956 | Phillips | 206/65 |
| 2,894,671 | 7/1959 | Nicholls | 108/55.1 X |
| 3,258,288 | 6/1966 | Courter | 24/288 X |
| 3,357,551 | 12/1967 | De Shazor, Jr. | 24/288 X |
| 3,477,631 | 11/1969 | Dunlap, Jr. et al. | 108/55.1 X |
| 3,636,888 | 1/1972 | Angelbeck, Jr. | 108/55.3 X |
| 3,654,875 | 4/1972 | Vik | 108/55.3 X |
| 3,677,436 | 7/1972 | Danielson | 108/53.1 X |
| 3,754,645 | 8/1973 | Kilroy | 108/55.1 X |
| 3,797,727 | 3/1974 | Downing et al. | 108/55.1 X |
| 3,834,323 | 9/1974 | Weinmann | 108/51.1 |
| 3,904,030 | 9/1975 | Repp et al. | 206/319 |
| 3,948,190 | 4/1976 | Cook, III et al. | 108/53.3 |
| 3,949,876 | 4/1976 | Bridges et al. | 206/427 |
| 3,993,168 | 11/1976 | Kubick | 108/55.3 X |
| 3,995,749 | 12/1976 | Haskins | 108/55.1 X |
| 4,263,855 | 4/1981 | Lawlor | 108/55.3 X |
| 4,293,072 | 10/1981 | Hill et al. | 206/512 |
| 4,516,677 | 5/1985 | Rowland et al. | 108/53.1 X |

FOREIGN PATENT DOCUMENTS

| | | | |
|---|---|---|---|
| 2450216 | 5/1976 | Fed. Rep. of Germany | 108/55.3 |
| 911438 | 11/1962 | United Kingdom | 108/55.1 |

*Primary Examiner*—Jose V. Chen

[57] ABSTRACT

A pallet assembly having a plurality of panels with depressions formed therein to receive the flanges of wire reels wherein the reel flanges are secured in the depressions by tabs on the panels.

6 Claims, 2 Drawing Sheets

PALLET ASSEMBLY WHICH INTERLOCKS WITH WIRE REELS

This invention relates to a pallet assembly for shipping reels of material such as wound electrical wire.

In the past it was common practice to package individual reels of wound wire in corrugated boxes for shipping purposes. A number of such packaged reels would be stacked on a wooden pallet and tied down to prevent movement during transportation to their ultimate user. Upon arrival at a user's facility each reel would have to be unpackaged in order to be used. Both the wooden pallets and the corrugated boxes became waste products and presented problems of disposal. Moreover, there was no easy way to return emptied reels to the wire producer for reuse.

It is an object of this invention to provide a better packaging arrangement for shipping reels of material such as wound electrical wire.

It is another object of this invention to provide a packaging arrangement which makes it easy for wire users to ship empty reels back to wire producers.

One of the advantages of the invention is that it reduces waste products of wire users. It also reduces material handling by both wire users and producers.

One of the features of the invention is that it provides a package for returning empty reels which requires no banding or strapping in order to be secured for shipping.

In carrying out the invention there is provided a pallet assembly for transporting reels of electrical wire. The reels have flanges at each end. The pallet assembly comprises a bottom panel with a top surface. The top surface has a plurality of depressions formed therein. Each depression is dimensioned to receive one of the flanges of a reel. The assembly also includes a top panel with a bottom surface opposite the top surface of the bottom panel. The bottom surface has a plurality of depressions formed therein which are also dimensioned to receive one of the flanges of a reel. The depressions of the bottom panel and the top panel have centers each of which is in substantial registry with a center of a depression of an oppositely facing panel. The top surface and the bottom surface have a plurality of tabs on the periphery of each depression to secure a reel flange in its associated depression once such a flange is placed therein.

Figure 1:
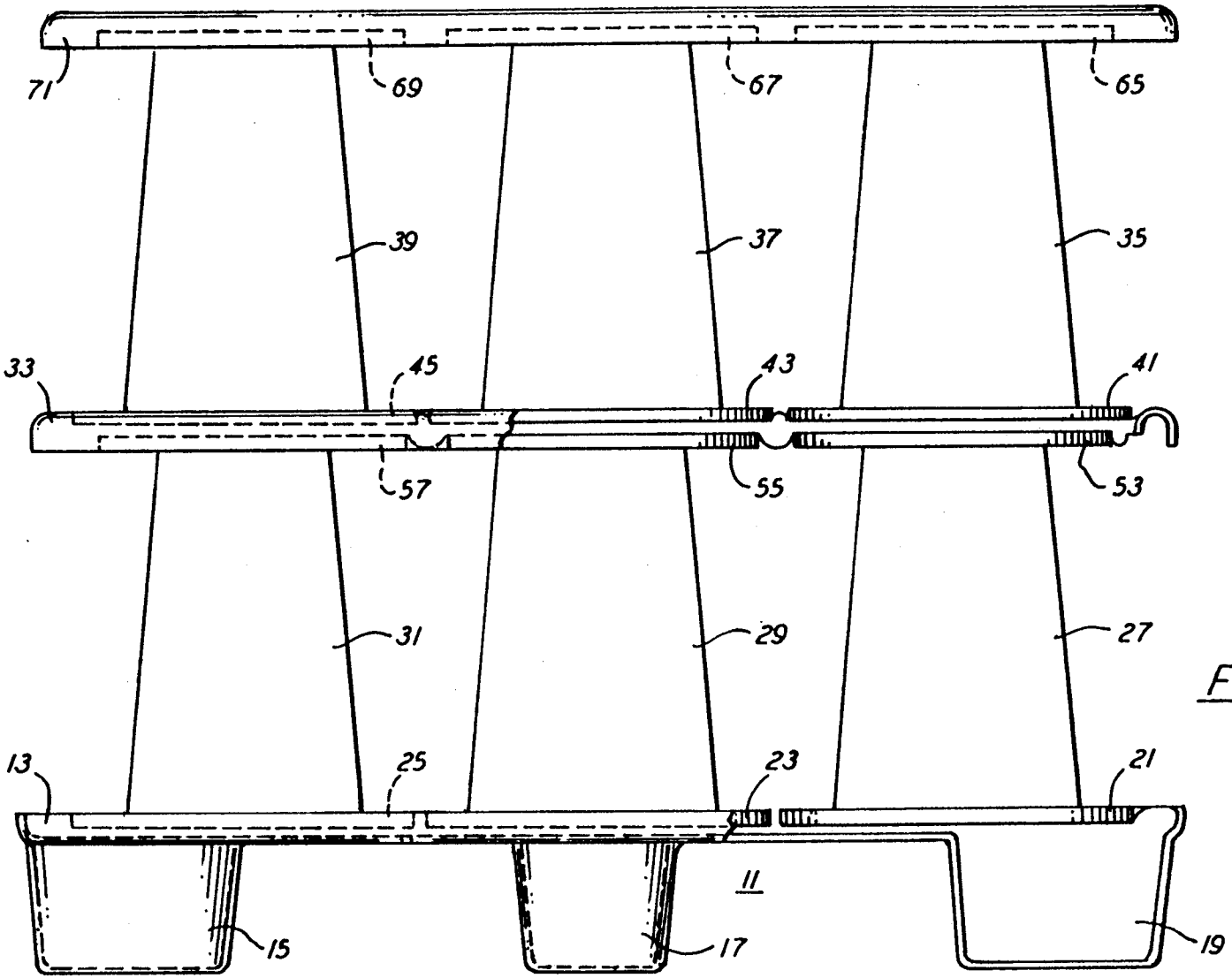
Figure 2:
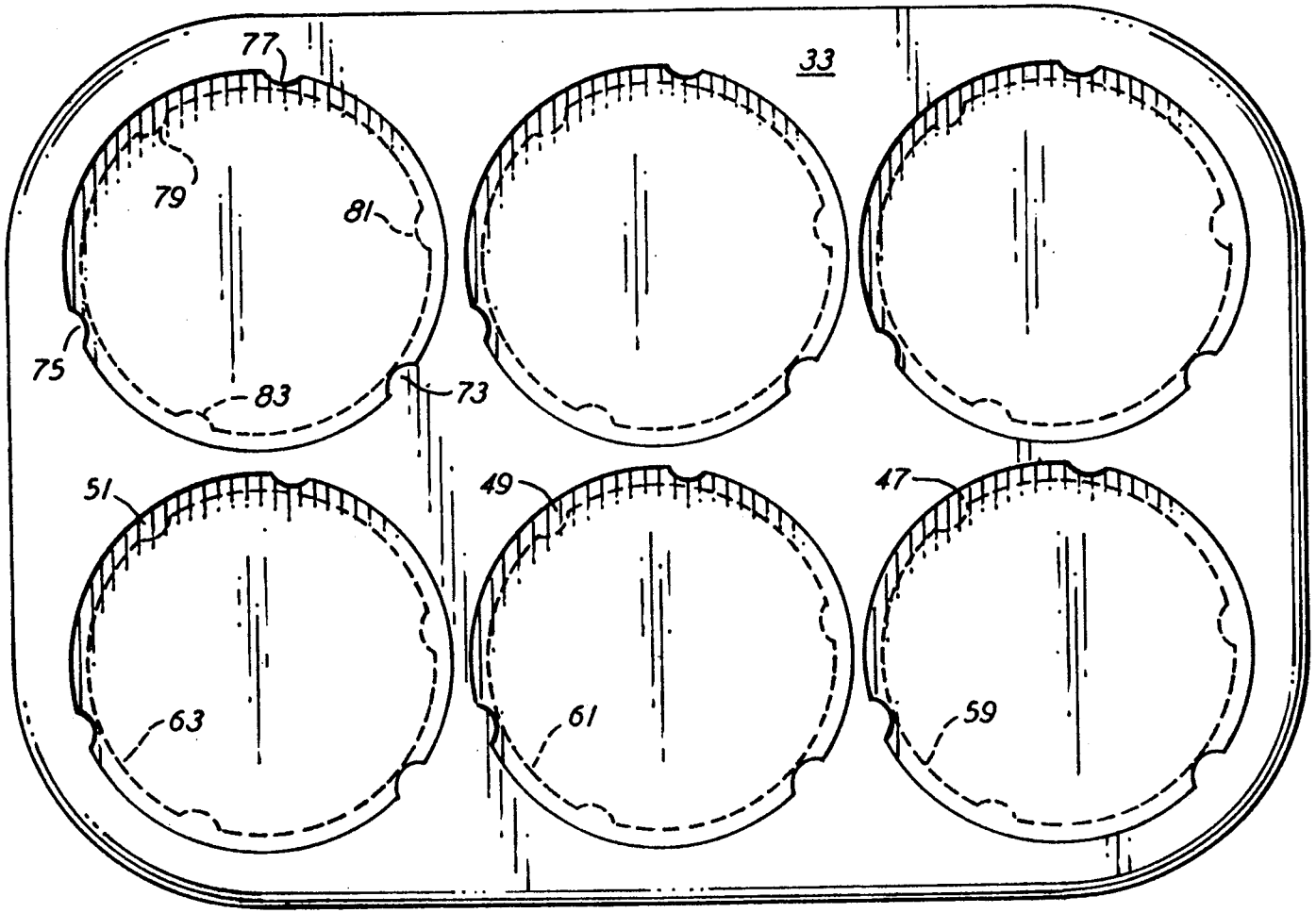

Other objects, features and advantages of the invention will be apparent from the following description and appended claims when considered in conjunction with the accompany drawing in which:

FIG. 1 is a side view of the pallet assembly of the invention with part of that assembly shown in section; and FIG. 2 is a top view of part of the assembly of FIG. 1.

Referring to FIG. 1 there is shown a body 11 which provides a bottom panel 13 for the pallet assembly of the invention. Bottom panel 13 is supported on leg 15, 17 and 19. The support legs are separated sufficiently from each other to provide access for the forks of a forklift truck.

Formed in the top surface of panel 13 are six depressions dimensioned to receive the round bottom flanges of six wire reels such as flanges 21, 23 and 25 of reels 27, 29 and 31. The depressions in the top of panel 13 have not been clearly delineated in FIG. 1 in order to keep the drawing simple and uncomplicated. As those skilled in the art will understand the depressions in panel 13 would be similar to those in the top surface of separator panel 33 (see FIG. 2). These depressions and those in the top surface of panel 13 are larger in circumference than the depressions formed in the bottom of separator panel 33. This can be clearly seen in FIG. 2 of the drawing. The reason for this is that the wire reels used in the pallet assembly have round flanges which are larger at the bottom than at the top. Although it is not clear from FIG. 1, FIG. 2 shows that separator panel 33 has depressions for six reels to be stacked on top of six other reels in the disclosed pallet assembly. Three of these reels, reel 35, reel 37 and reel 39 are shown in FIG. 1 with their flanges 41, 43 and 45 respectively located in depressions 47, 49 and 51 (FIG. 2) of separator panel 33.

The upper flanges 53, 55 and 57 of reels 27, 29 and 31 are located in depressions 59, 61 and 63 (FIG. 2), respectively, in the bottom surface of separator panel 33. The round upper flanges 65, 67 and 69 of reels 35, 37 and 39 are located in properly dimensioned depressions in the bottom surface of top panel 71.

As can be appreciated from the drawing the center of each of the depressions is in substantial registry with the center of the depressions located above and/or below it. Each of the surfaces in which the depressions are formed are also provided with tabs such as tabs 73, 75, 77, 79, 81 and 83 shown for the depressions in the upper and lower surfaces of panel 33 shown in the upper left-hand corner of FIG. 2. With such tabs the flanges of reels are snap fitted into associated depressions. It should be understood that if only six reels were to be shipped a separator panel such as 33 would not be necessary and the pallet assembly would be formed with only bottom panel 13 and top panel 71.

In order to protect the reels on a pallet assembly made in accordance with the invention from weather conditions in transit, it is intended that each such assembly would be covered by a shrink-wrap material (not shown). It is also intended to have the top panels of such assemblies such as panel 71 and the bottom panels such as panel 13 be made of different colors, such as one being black and the other being white. This would facilitate stacking one pallet assembly atop another.

It is to be understood that with snap fitting tabs such as 73 through 83 associated with each of the depressions, each flange of a reel is secured in its associated depression. Moreover with such an arrangement of flanges and tabs the entire pallet is of an interlocking nature in which panels 13, 33 and 71 hold the reels for shipping and the flanges of the reels locate and hold the panels as part of the assembly. With this assembly a user of wire can readily take it apart, de-reel the wire from each of the twelve reels in the assembly and then put the assembly back together again with the empty reels for shipment back to the wire producer.

In a constructed embodiment the body 11, separator panel 33 and top panel 7, were made of polyethylene, 25 inches $\times$37 inches in plan view with 12 reels each 13 inches high weighing 100 pounds when filled with wire and having 10 inch diameter top flanges and 11 inch diameter bottom flanges. The tabs for this embodiment were about 1 inch long half round protruding from the edges of the depressions about one-half inch. The top panel for this embodiment had an indented upper surface starting close enough to its edges to have the feet of another assembly stacked on it settle into the indentation to facilitate stacking.

Various modifications to the above described embodiment may be made. For that purpose the description is to be understood to be for illustrative purposes only and not limiting.

What is claimed is:

1. A pallet assembly for transporting reels of electrical wire, said reels having flanges at each end, comprising a bottom panel with a top surface, said top surface having a plurality of depressions formed therein, each said depression being dimensioned to receive one of the flanges of a reel of wire;

a top panel opposite said bottom panel with a bottom surface, said bottom surface having a plurality of depressions formed therein, said depressions being dimensioned to receive one of the flanges of a reel of wire;

said depressions of said bottom panel and said top panel having centers, each of which is in substantial registry with a center of a depression of an opposite panel;

said top surface and said bottom surface having a plurality of tabs inwardly extending on the periphery of each depression to secure a reel flange in its associated depression once placed therein.

2. A pallet assembly as claimed in claim 1, including a separator panel with a top surface and a bottom surface and having a plurality of depressions formed in each said surface of said separator panel, each said depression being dimensioned to receive one of the flanges of a reel.

3. A pallet assembly as claimed in claim 2, wherein said depressions in said separator panel have centers, each of which is in substantial registry with a center of a depression in said top and bottom panels.

4. A pallet assembly as claimed in claim 3, wherein said top surface and said bottom surface of said separator panel have a plurality of tabs inwardly extending on the periphery of each depression in said surfaces to secure a reel flange in its associated depression once placed therein.

5. A pallet assembly as claimed in claim 4 wherein the depressions in the top surface of said bottom panel and the top surface of said separator panel are round and of a first size circumference.

6. A pallet assembly as claimed in claim 5 wherein the depressions in the bottom surface of said top panel and the bottom surface of said separator panel are round and of a second size circumference, said second size being smaller than said first size.

* * * * *